US009375962B1

(12) United States Patent
Donaldson et al.

(10) Patent No.: US 9,375,962 B1
(45) Date of Patent: Jun. 28, 2016

(54) SYSTEM AND METHOD FOR IDENTIFICATION OF MARKS IN PRINTED TEST PATTERNS

(71) Applicant: Xerox Corporation, Norwalk, CT (US)

(72) Inventors: Patricia J. Donaldson, Pittsford, NY (US); Michael B. Monahan, Webster, NY (US); James P. Calamita, Spencerport, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/746,894

(22) Filed: Jun. 23, 2015

(51) Int. Cl.
*B41J 29/393* (2006.01)

(52) U.S. Cl.
CPC ..... *B41J 29/393* (2013.01)

(58) Field of Classification Search
CPC .... B41J 29/393; B41J 2/17546; B41J 2/0458; B41J 2/0451; B41J 2/2135
USPC ..... 347/19
See application file for complete search history.

(56) References Cited

U.S. PATENT DOCUMENTS 5,343,231 A 8/1994 Suzuki
5,451,990 A 9/1995 Sorenson et al.
5,600,350 A 2/1997 Cobbs et al.
5,796,414 A 8/1998 Sievert et al.
6,076,915 A 6/2000 Gast et al.
6,089,693 A 7/2000 Drake et al.
6,196,652 B1 3/2001 Subirada et al.
6,275,600 B1 8/2001 Banker et al.
6,300,968 B1 10/2001 Kerxhalli et al.
6,334,720 B1 1/2002 Kato et al.
6,377,758 B1 4/2002 OuYang et al.
6,467,867 B1 10/2002 Worthington et al.
6,494,558 B1 12/2002 Doval et al.
6,554,390 B2 4/2003 Arquilevich et al.
6,637,853 B1 10/2003 Ahne et al.
6,819,352 B2 * 11/2004 Mizes ..... G06K 15/027 347/240
6,847,465 B1 1/2005 Wetchler et al.
6,883,892 B2 4/2005 Sievert et al.
6,942,313 B2 9/2005 Kanda
6,993,275 B2 1/2006 Mitsuya et al.
7,073,883 B2 7/2006 Billow
7,118,188 B2 10/2006 Vilanova et al.
7,254,254 B2 8/2007 Ueda et al.
7,309,118 B2 12/2007 Mizes et al.
7,380,897 B2 6/2008 Anderson et al.
7,390,073 B2 6/2008 Bailey et al.
7,391,525 B2 6/2008 Chapman et al.
7,478,894 B2 1/2009 Kim et al.
7,515,305 B2 4/2009 Mizes
7,549,721 B2 6/2009 Nakano et al.
7,552,986 B2 6/2009 Mizes et al.
7,607,752 B2 10/2009 Childers et al.
7,630,653 B2 12/2009 Bonino (Continued)

*Primary Examiner* — Manish S Shah
*Assistant Examiner* — Yaovi M Ameh
(74) *Attorney, Agent, or Firm* — Maginot Moore & Beck LLP

(57) ABSTRACT

A method of analyzing a printed test pattern includes printing first and second rows of marks, each row including at least two pluralities of marks. A gap between two pluralities of marks in the first row is located in a first position in a cross-process direction that is different than a second position of another gap between pluralities of marks in the second row. A controller identifies the first row of marks with reference to a predetermined set of image data corresponding to the first row of marks including the first plurality of marks, the second plurality of marks, and the gap in the first row.

10 Claims, 5 Drawing Sheets

(56) References Cited

U.S. PATENT DOCUMENTS

| | | | |
|---|---|---|---|
| 7,637,586 | B2 | 12/2009 | Yun |
| 7,686,298 | B2 | 3/2010 | Fioravanti et al. |
| 8,662,625 | B2 | 3/2014 | Donaldson |
| 2002/0135629 | A1 | 9/2002 | Sarmast et al. |
| 2003/0231350 | A1 | 12/2003 | Yamagishi |
| 2004/0160468 | A1 | 8/2004 | Kim et al. |
| 2005/0099447 | A1 | 5/2005 | Hsu et al. |
| 2009/0003729 | A1* | 1/2009 | Metcalfe ..... H04N 1/00002 382/287 |
| 2009/0322849 | A1 | 12/2009 | Calamita et al. |
| 2010/0013882 | A1 | 1/2010 | Mizes et al. |
| 2011/0242187 | A1* | 10/2011 | Mongeon ..... B41J 38/543 347/19 |

* cited by examiner

SYSTEM AND METHOD FOR IDENTIFICATION OF MARKS IN PRINTED TEST PATTERNS

TECHNICAL FIELD

This disclosure is directed to inkjet printers and, more particularly, to systems and methods of printing test patterns and analyzing scanned image data of the test patterns in inkjet printers.

BACKGROUND

Inkjet printers form printed images using one or more printheads that include arrays of inkjets ejectors. A controller in the printer operates the inkjets to form printed images that often include both text and graphics and may be formed using one or more ink colors. Some printer embodiments employ multiple printheads that each includes hundreds or thousands of ejectors. Multiple printheads form different portions of a printed image and, in multicolor printer configurations, different printheads emit different ink colors to form multicolor printed images.

During operation, some printer embodiments monitor the alignment and operation of the printheads that form printed images. Two printheads are "registered" with each other when the printheads are aligned with each other in a predetermined configuration to enable ink drops ejected from both printheads to land on appropriate regions of an image receiving surface to form printed images. For example, two printheads that eject different colors of ink may be aligned with each other in a cross-process direction to enable both printheads to print ink onto the same region of a print medium. The two printheads eject drops that appear to blend together to form all or portions of multicolor images on the print medium. In another configuration, an array of two or more printheads are registered across the print zone in a "stitched" configuration that enables two or more printheads to form continuous printed images that are wider than the width of an individual printhead.

To maintain registration between printheads, the printer operates the printheads to form a predetermined arrangement of printed marks that is referred to as a "test pattern." An optical sensor scans the printed test patterns to enable a controller or other image processing device to identify the individual marks. The controller identifies misregistration between printheads and optionally identifies inoperable inkjets in the printheads based on the positions of the printed marks in the test pattern. Prior art test patterns include regular arrays of printed dashes where a single inkjet ejects a series of ink drops to form a continuous dash in the test pattern.

One drawback of prior art test patterns is that the analysis of scanned image data for printhead registration and inoperable inkjet detection becomes less reliable when multiple marks near the edges of the test pattern are missing. In some instances, the edges of a paper print medium curl and make contact with some of the inkjets near the edges of the print zone. The paper absorbs ink from the inkjets and produces a temporary malfunction of the inkjets near the edges of the print zone. Printed test patterns that do not include a comparatively large number of marks at the edges of the test pattern may provide inaccurate information during printhead registration and inoperable inkjet detection processes. Consequently, improved systems and methods for the generation and analysis of printed test patterns that remain effective for printed test patterns that are formed with missing marks would be beneficial.

SUMMARY

In one embodiment, a method for identifying rows of printed marks in a test pattern has been developed. The method includes operating with a controller a first plurality of inkjets to form a first row of printed marks arranged in a cross-process direction on an image receiving surface with reference to predetermined image data that include the first row of marks and at least a second row of marks, the first row of marks including a first plurality of marks and a second plurality of marks, the first plurality of marks being separated from the second plurality of marks by a first gap in the predetermined image data in a first location in the cross-process direction, the first location being different than a second location in the cross-process direction of a second gap formed between a third plurality of marks and a fourth plurality of marks in the second row in the predetermined image data, generating with an optical sensor first scanned image data of the first row of printed marks, and identifying with the controller the first row of printed marks in the first scanned image data with reference to a location of a first plurality of printed marks, a location of a second plurality of printed marks, and a location of a first gap on the image receiving surface in the cross-process direction.

In another embodiment, an inkjet printer that is configured to analyze printed test patterns has been developed. The inkjet printer includes a first plurality of inkjets configured to eject ink drops onto an image receiving surface as the image receiving surface moves in a process direction, an optical sensor configured to generate image data of the image receiving surface, a memory configured to store predetermined image data that include a first row of marks and at least a second row of marks, the first row of marks including a first plurality of marks and a second plurality of marks, the first plurality of marks being separated from the second plurality of marks by a first gap in the predetermined image data in a first location in the cross-process direction, the first location being different than a second location in the cross-process direction of a second gap formed between a third plurality of marks and a fourth plurality of marks in the second row in the predetermined image data, and a controller operatively connected to the first plurality of inkjets, the optical sensor, and the memory. The controller is configured to operate the first plurality of inkjets to form a first row of printed marks arranged in a cross-process direction on the image receiving surface with reference to predetermined image data for the first row of marks, generate with the optical sensor first scanned image data of the first row of printed marks, and identify the first row of printed marks in the first scanned image data with reference to a location of a first plurality of printed marks, a location of a second plurality of printed marks, and a location of a first gap on the image receiving surface in the cross-process direction.

BRIEF DESCRIPTION OF THE DRAWINGS

The foregoing aspects and other features of an apparatus or printer that identifies printed marks in a test pattern are explained in the following description, taken in connection with the accompanying drawings.

DETAILED DESCRIPTION

Figure 1:
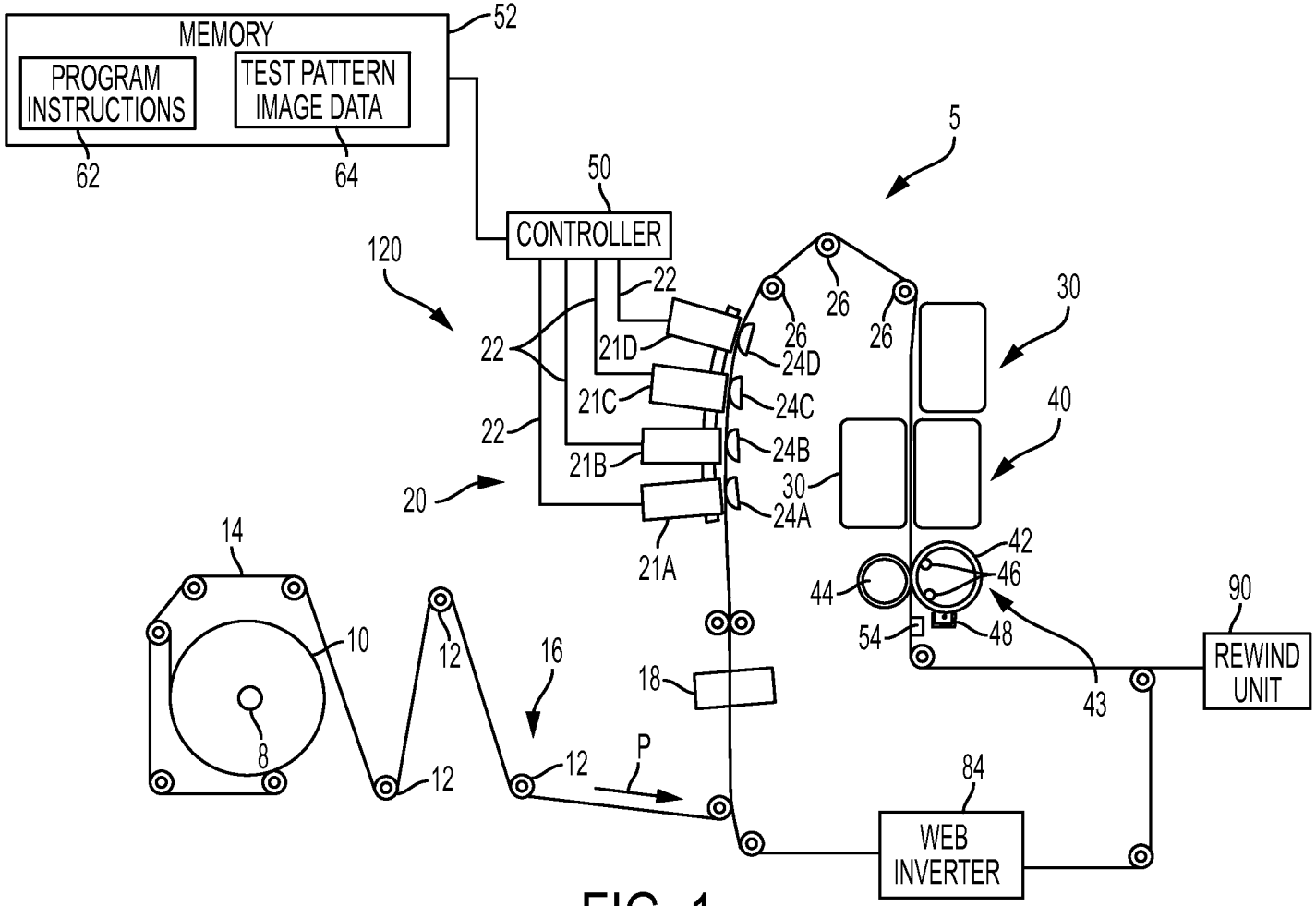
FIG. 1 is a schematic diagram of an inkjet printer that is configured to form printed test patterns including marks in a row that correspond to gaps formed between groups of printed marks in other rows of a test pattern.

For a general understanding of the environment for the device disclosed herein as well as the details for the device, reference is made to the drawings. In the drawings, like reference numerals designate like elements.

As used herein, the word "printer" encompasses any apparatus that produces images with colorants on media, such as digital copiers, bookmaking machines, facsimile machines, multi-function machines, three-dimensional object printers, and the like. As used herein, the term "process direction" refers to a direction of movement of an image receiving surface through the printer. For example, a continuous media web pulled from a roll of paper or other suitable print medium moves in the process direction along a media path through a printer. A media transport in the printer uses one or more actuators, such as electric motors, to move the print medium past one or more printheads in the print zone to receive ink images and passes other printer components, such as heaters, fusers, pressure rollers, and on-sheet optical imaging sensors, that are arranged along the media path. As used herein, the term "cross-process" direction refers to an axis that is perpendicular to the process direction along the image receiving surface. Examples of image receiving surfaces include the surfaces of print media such as paper or the surfaces of indirect image receiving members including rotating drums, endless belts, and platen.

As used herein, the term "mark" refers to an arrangement of printed ink or another suitable marking agent that a single inkjet in a print zone of a printer forms on the image receiving surface. In one embodiment, the inkjet ejects a single drop of ink to form the mark, while in other embodiments the inkjet ejects a series of drops that form a printed dash that extends in the process direction on the image receiving surface.

FIG. 1 is a schematic diagram of an inkjet printer 5. FIG. 1 is a simplified schematic view of the direct-to-sheet, continuous-media, phase-change inkjet printer 5, that is configured to generate test patterns using a plurality of printheads positioned in a print zone in the printer. A media supply and handling system is configured to supply a long (i.e., substantially continuous) web of media 14 of "substrate" (paper, plastic, or other printable material) from a media source, such as a spool of media 10 mounted on a web roller 8. For simplex printing, the printer includes the web roller 8, media conditioner 16, print zone or printing station 20, and rewind unit 90. For duplex operations, the web inverter 84 is used to flip the web to present a second side of the media to the printing station 20 before being taken up by the rewind unit 90. In the simplex operation, the media source 10 has a width that substantially covers the width of the rollers 12 and 26 over which the media travels through the printer. In duplex operation, the media source has a width that is approximately one-half of the width of the rollers. Thus, the web can travel over about one-half of the length of the rollers in the printing station 20 before being flipped by the inverter 84 and laterally displaced by a distance that enables the web to travel over the other half of the length of the rollers in the printing station 20. The rewind unit 90 is configured to wind the web onto a roller for removal from the printer and subsequent processing.

The media can be unwound from the source 10 as needed and propelled by a variety of motors, not shown, rotating one or more rollers. The media conditioner includes rollers 12 and a pre-heater 18. The rollers 12 control the tension of the unwinding media as the media moves along a path through the printer. In alternative embodiments, the media can be transported along the path in cut sheet form in which case the media supply and handling system can include any suitable device or structure that enables the transport of cut media sheets along an expected path through the imaging device. The pre-heater 18 brings the web to an initial predetermined temperature that is selected for desired image characteristics corresponding to the type of media being printed as well as the type, colors, and number of inks being used. The pre-heater 18 can use contact, radiant, conductive, or convective heat to bring the media to a target preheat temperature, which in one practical embodiment, is in a range of about 30° C. to about 70° C.

The media are transported through a printing station 20 that includes a series of color units 21A, 21B, 21C, and 21D, each color unit effectively extending across the width of the media and being able to place a marking agent directly (i.e., without use of an intermediate or offset member) onto the moving media. The controller 50 is operatively connected to the color units 21A-21D through control lines 22. Each of the color units 21A-21D includes a plurality of printheads positioned in a staggered arrangement in the cross-process direction over the media web 14. As is generally familiar, each of the printheads can eject a single color of ink, one for each of the colors typically used in four color printing, namely, cyan, magenta, yellow, and black (CMYK). The controller 50 of the printer receives velocity data from encoders mounted proximately to rollers positioned on either side of the portion of the path opposite the four printheads to compute the position of the web as it moves past the printheads. The controller 50 uses these data to generate timing signals for actuating the inkjets in the printheads to enable the four colors to be ejected with a reliable degree of accuracy for registration of the differently color patterns to form four primary-color images on the media. The inkjets actuated by the firing signals correspond to image data processed by the controller 50. The image data can be transmitted to the printer, generated by a scanner (not shown) that is a component of the printer, or otherwise electronically or optically generated and delivered to the printer. In various alternative embodiments, the printer 5 includes a different number of color units and can print inks having colors other than CMYK.

In the illustrative embodiment of FIG. 1, the printer 5 uses four different colors of "phase-change ink," by which is meant that the ink is substantially solid at room temperature and substantially liquid when heated to a phase change ink melting temperature for jetting onto the imaging receiving surface. Alternative printer embodiments use a single color of ink or a different number of ink colors. The phase change ink melting temperature can be any temperature that is capable of melting solid phase change ink into liquid or molten form. In one embodiment, the phase change ink melting temperature is approximately 70° C. to 140° C. In alternative embodiments, the ink utilized in the imaging device can comprise UV curable gel ink. Gel ink can also be heated before being ejected by the inkjets of the printhead. Alternative embodiments of the printer 5 use aqueous inks that are liquid at room temperature. As used herein, liquid ink refers to melted solid ink, heated gel ink, or other known forms of ink, such as aqueous inks, ink emulsions, ink suspensions, ink solutions, or the like.

The printheads in the printer 5 eject drops of ink to form printed images that are visible on the surface of the media web 14 and to form sparse test patterns that are visible to the optical sensor 54 in the inter-document zones between printed pages. The ink used in the printer 5 is an example of a "marking agent". As used herein, the term "marking agent" refers to any material that is ejected from the printheads in a printer onto an image receiving surface for either traditional two-dimensional printing or in three-dimensional object printing. For example, high-contrast inks such as CMYK inks that are ejected onto a paper print medium or an indirect image receiving member are common examples of marking agents that are used in traditional document printing applications. In three-dimensional object printers, the marking agent may be a build material that the printheads eject in a series of layers to form a three-dimensional object. Some forms of build material also exhibit high optical contrast with an image receiving surface, while other forms of build material are lower-contrast materials that are more difficult to detect in scanned image data. As described below, a template matching process improves the accuracy of identifying printed marks that are formed from a wide range of marking agents, including sparse test patterns that are formed from the high-contrast inks and sparse or non-sparse test patterns that are formed from lower-contrast marking agents such as build materials that are used in three-dimensional object printers.

Associated with each of color units 21A-21D is a corresponding backing member 24A-24D, respectively. The backing members 24A-24D are typically in the form of a bar or roll, which is arranged substantially opposite the printhead on the back side of the media. Each backing member is used to position the media at a predetermined distance from the printhead opposite the backing member. In the embodiment of FIG. 1, each backing member includes a heater that emits thermal energy to heat the media to a predetermined temperature that, in one practical embodiment, is in a range of about 40° C. to about 60° C. The various backer members can be controlled individually or collectively. The pre-heater 18, the printheads, backing members 24 (if heated), as well as the surrounding air combine to maintain the media along the portion of the path opposite the printing station 20 in a predetermined temperature range of about 40° C. to 70° C.

As the partially-imaged media web 14 moves to receive inks of various colors from the printheads of the print zone 20, the printer 5 maintains the temperature of the media web within a given range. The printheads in the color units 21A-21D eject ink at a temperature typically significantly higher than the temperature of the media web 14. Consequently, the ink heats the media. Therefore, other temperature regulating devices may be employed to maintain the media temperature within a predetermined range. For example, the air temperature and air flow rate behind and in front of the media may also impact the media temperature. Accordingly, air blowers or fans can be utilized to facilitate control of the media temperature. Thus, the printer 5 maintains the temperature of the media web 14 within an appropriate range for the jetting of all inks from the printheads of the print zone 20. Temperature sensors (not shown) can be positioned along this portion of the media path to enable regulation of the media temperature.

Following the print zone 20 along the media path, the media web 14 moves over guide rollers 26 to one or more "mid-heaters" 30. A mid-heater 30 can use contact, radiant, conductive, and/or convective heat to control a temperature of the media. Depending on the temperature of ink and paper at rollers 26, this "mid-heater" can add or remove heat from the paper and/or ink. The mid-heater 30 brings the ink placed on the media to a temperature suitable for desired properties when the ink on the media is sent through the spreader 40. In one embodiment, a useful range for a target temperature for the mid-heater is about 35° C. to about 80° C. The mid-heater 30 has the effect of equalizing the ink and substrate temperatures to within about 15° C. of each other. Lower ink temperature gives less line spread while higher ink temperature causes show-through (visibility of the image from the other side of the print). The mid-heater 30 adjusts substrate and ink temperatures to 0° C. to 20° C. above the temperature of the spreader.

Following the mid-heaters 30, a fixing assembly 40 applies heat and/or pressure to the media to fix the images to the media. The fixing assembly 40 includes any suitable device or apparatus for fixing images to the media including heated or unheated pressure rollers, radiant heaters, heat lamps, and the like. In the embodiment of FIG. 1, the fixing assembly includes a "spreader" 43, that applies a predetermined pressure, and in some implementations, heat, to the media. The function of the spreader 40 is to take what are essentially droplets, strings of droplets, or lines of ink on web 14 and smear them out by pressure and, in some systems, heat, so that spaces between adjacent drops are filled and image solids become uniform. In addition to spreading the ink, the spreader 40 also improves image permanence by increasing ink layer cohesion and/or increasing the ink-web adhesion. The spreader 43 includes rollers, such as image-side roller 42 and pressure roller 44, to apply heat and pressure to the media. Either roll can include heat elements, such as heating elements 46, to bring the web 14 to a temperature in a range from about 35° C. to about 80° C. In alternative embodiments, the fixing assembly can be configured to spread the ink using non-contact heating (without pressure) of the media after the print zone. Such a non-contact fixing assembly uses any suitable type of heater to heat the media to a desired temperature, such as a radiant heater, UV heating lamps, and the like. In another printer embodiment that employs aqueous ink, the fixing assembly 40 does not include a spreader, such as the spreader 40, but includes one or more heaters that dry aqueous ink on the media web after the media web passes through the print zone 20. In a UV ink printer embodiment, the fixing assembly 40 includes UV light sources that direct UV radiation at the ink to cross-link and fix the ink to the surface of the media web.

In one practical embodiment, the roller temperature in spreader 40 is maintained at an optimum temperature that depends on the properties of the ink such as 55° C.; generally, a lower roller temperature gives less line spread while a higher temperature causes imperfections in the gloss. Roller temperatures that are too high may cause ink to offset to the roll. In one practical embodiment, the nip pressure is set in a range of about 500 to about 2000 psi lbs/side.

The spreader 40 also includes a cleaning/oiling station 48 associated with image-side roller 42. The station 48 cleans and/or applies a layer of some release agent or other material to the roller surface. In the printer 5, the release agent material is an amino silicone oil having viscosity of about 10-200 centipoises. Only small amounts of oil are required and the oil carried by the media is only about 1-10 mg per A4 size page. In one possible embodiment, the mid-heater 30 and spreader 40 can be combined into a single unit, with their respective functions occurring relative to the same portion of media simultaneously. In another embodiment, the media is maintained at a high temperature during the printing operation to enable the spreader 40 to spread the ink while the ink is in a liquid or semi-liquid state.

Following passage through the spreader 40, the printed media can be wound onto a roller for removal from the system (simplex printing) or directed to the web inverter 84 for inversion and displacement to another section of the rollers for a second pass by the printheads, mid-heaters, and spreader. The duplex printed material is subsequently wound onto a roller for removal from the system by rewind unit 90. Alternatively, additional processing stations receive the print medium and perform tasks such as cutting, binding, collating, and/or stapling the media or the like.

Operation and control of the various subsystems, components and functions of the printer 5 are performed with the aid of the controller 50. The controller 50 is implemented with general or specialized programmable processors that execute programmed instructions. The instructions and data required to perform the programmed functions are stored in a memory 52 that is operatively connected to the controller 50. The memory 52 includes volatile data storage devices such as random access memory (RAM) and non-volatile data storage devices including magnetic and optical disks or solid state storage devices. The processors, their memories, and interface circuitry configure the controllers and/or print engine to perform the test pattern formation and image data analysis processes described herein. These components are provided on a printed circuit card or provided as a circuit in an application specific integrated circuit (ASIC). In one embodiment, each of the circuits is implemented with a separate processor device. Alternatively, the circuits can be implemented with discrete components or circuits provided in VLSI circuits. Also, the circuits described herein can be implemented with a combination of processors, ASICs, discrete components, or VLSI circuits.

As described in more detail below, the controller 50 executes stored program instructions 62 in the memory 52 to form printed patterns on the media web 14 with reference to predetermined test pattern image data 64. The controller 50 operates the printheads and corresponding inkjets in the color units 21A-21D to form printed test patterns on the media web 14 with reference to the test pattern image data 64. As described below, the controller 50 forms printed test patterns based on the test pattern image data 64 to form rows of marks that are arranged into a plurality of mark groups with a row including marks that the controller 50 uses to identify groups of marks that are arranged in a single row of the test pattern. The printer 5 uses the scanned image data to identify rows of printed marks in a test pattern more accurately to improve printhead registration and inoperable inkjet detection processes.

The printer 5 includes an optical sensor 54 that is configured to generate image data corresponding to the media web 14 and printed test patterns formed on the media web 14. The optical sensor is configured to generate signals indicative of reflectance levels of the media, ink, or backer roll opposite the sensor to enable detection of, for example, the presence and/or location of ink drops jetted onto the receiving member by the inkjets of the printhead assembly. The optical sensor 54 includes an array of optical detectors mounted to a bar or other longitudinal structure that extends across the width of an imaging area on the image receiving member. While FIG. 1 depicts an optical sensor 54 that is used in the inkjet printer 5, in a three-dimensional object printer embodiment, the sensor 54 could be embodied as either an optical sensor, or as a height sensor that detects variations in the height of an object due to different patterns of material that the printer forms on a surface of the object. The three-dimensional printer forms a test pattern in a similar manner to the methods described herein, and the height sensor generates a height map corresponding to the locations of printed marks in the test pattern including mark groups and gaps between the mark groups that are formed in different rows of the test pattern. The three-dimensional object printer analyzes the height map to identify inoperable inkjets and perform printhead registration in the three-dimensional object printer in a similar manner to the methods described herein for a two-dimensional inkjet printer.

In one embodiment, the imaging area is approximately twenty inches wide in the cross-process direction and the inkjets in the printheads form printed marks in test patterns and other printed images at a resolution of 600 dots per inch (DPI) in the cross-process direction. In this embodiment, over 12,000 optical detectors are arrayed in a single row along the bar to generate a single scanline of image data corresponding to a line across the image receiving member. The optical detectors are configured in association with one or more light sources that direct light towards the surface of the image receiving member. The optical detectors receive the light generated by the light sources after the light is reflected from the image receiving member, such as the media web 14. The magnitude of the electrical signal generated by an optical detector corresponds to the amount of light reflected into the detector from the surface of the media web 14, including bare portions of the media web surface and portions that carry printed ink patterns. The magnitudes of the electrical signals generated by the optical detectors are converted to digital values by an appropriate analog/digital converter.

Figure 2:
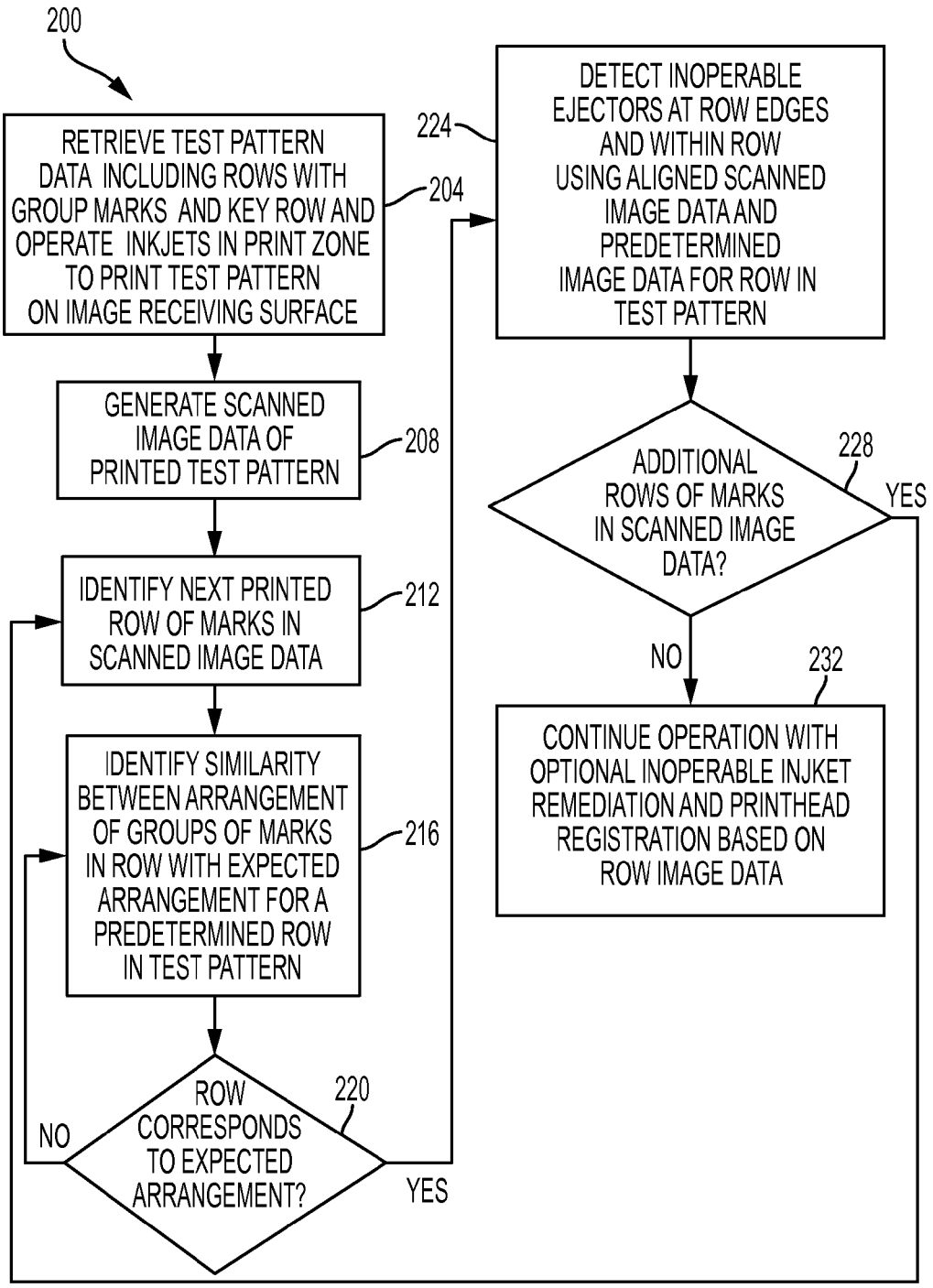
FIG. 2 is a block diagram of a process for identifying printed marks in a test pattern including marks in a row that correspond to gaps formed between groups of printed marks in other rows of a test pattern.

FIG. 2 is a block diagram of process 200 for generating and analyzing printed test patterns in an inkjet printer. In the discussion below, a reference to the process 200 performing a function or action refers to the operation of a processor or controller that executes stored instructions to perform the function or action with other components in the printer. Process 200 is described in conjunction with the printer 5 of FIG. 1 for illustrative purposes.

Process 200 begins as the controller 50 in the printer 5 retrieves the test pattern data 64 from the memory 52 and forms the printed test pattern on an image receiving surface, such as the media web 14 in the printer 5 (block 204). The controller 50 uses the stored test pattern image data 64 from the memory 52 to control the operation of the inkjets that form the printed marks in the test pattern. The printed test pattern data include multiple rows of printed marks, such as dashes or single-drop marks, from a plurality of inkjets in the printheads of the print zone 20. The test pattern image data includes the multiple rows that are separated from each other along the process direction and the printer 5 forms the corresponding printed test pattern with each row occupying a different portion of the image receiving surface. As described below, during process 200 the controller 50 identifies individual rows in scanned image data of the printed test pattern with reference to the locations and arrangement of gaps between groups of marks in each row in comparison to different portions of the predetermined image data of each row. During operation, the controller 50 operates different pluralities of the inkjets in the print zone 20 to print multiple rows of marks in the test pattern.

Figure 3:
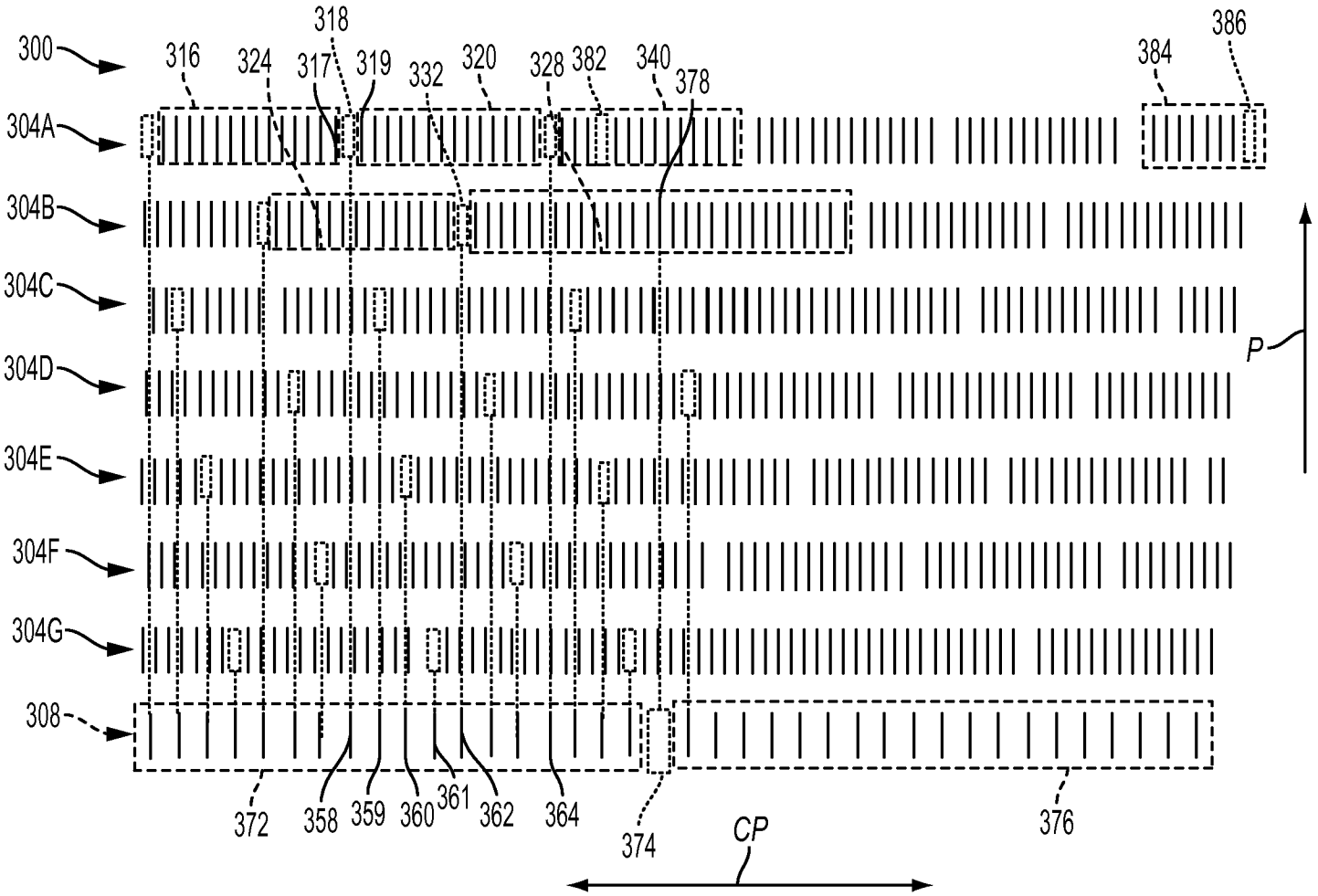
FIG. 3 is a diagram that depicts a portion of a printed test pattern including groups of marks formed in multiple rows of the test pattern and a row that includes marks aligned with gaps formed between the groups of marks in the remaining rows.

FIG. 3 depicts an illustrative example of a test pattern 300 that includes seven rows of printed marks 304A-304G. Each of the printed marks depicted in test pattern 300 is formed by one or more ink drops that one inkjet in the print zone 20 emits in response to firing signals from the controller 50. In some embodiments, the controller 50 forms each row of marks using inkjets in one printhead in the print zone. In other embodiments, the controller 50 operates inkjets in different sets of printheads in the color units 21A-21D to form rows with different color marks that are formed by different printheads in the print zone 20. In the test pattern 300, each of the rows 304A-304G and 308 include marks that are arranged along the cross-process direction CP and the rows are separated from each other by a predetermined distance along the process direction P. Each of the rows 304A-304G is further divided into groups of printed marks. As used herein, the term "group" as applied to marks in a test pattern refers to a plurality of printed marks that are formed in one row of a test pattern with the marks being uniformly spaced from each other by a first predetermined distance in the cross-process direction. Multiple groups of marks arranged in the cross-process direction form a row of marks, and a gap separates adjacent groups in each row along the cross-process direction CP. FIG. 3 depicts only a portion of a larger test pattern for illustrative purposes, but those of skill in the art will recognize that the test pattern embodiment of FIG. 3 can be modified to include print zones with a larger or smaller number of inkjets and similar test patterns that include a different number of rows and arrangement of mark groups.

In the test pattern 300, the row 308 includes another arrangement of marks that are each aligned with a gap formed in one of the rows 304A-304G. For example, row 304A includes groups of marks 316 and 320. Row 304B includes groups 324 and 328. The printer 5 forms each group of marks using a predetermined number of inkjets to form each group, such as a set of fourteen inkjets that are separated from each other by a uniform distance in the cross-process direction CP to produce marks that are arranged in a uniform manner in each group. Multiple groups of printed marks form each of the rows 304A-304G in the test pattern 300. A gap 318 separates the groups 316 and 320 in the row 304A. The row 308 includes the marks that correspond to the inkjets that are located in the gaps of the other rows 304A-304G. The test pattern 300 may include marks formed by all of the inkjets in one printhead or a group of printheads to identify inoperable inkjets and improve the accuracy of printhead registration. Alternatively, a subset of the rows may be printed, in order to measure print head registration. i.e. A test pattern used to detect inoperable jets would need to contain all of the rows 304A-G plus the row 308, while a test pattern designed to improve printhead registration might only include rows 304A-304C.

In the test pattern 300, the gap 318 corresponds to a region of the image receiving surface that is large enough to include one printed mark from one inkjet in the plurality of inkjets in the print zone 20, but the test pattern data corresponding to the test pattern 300 do not include a printed mark in the gap region 318. Instead, the test pattern 300 includes the mark for the gap 318 in the row 308. In FIG. 3, the mark 358 in the row 308 is aligned with the gap 318. The controller 50 controls the operation of an inkjet that lies between the inkjets that form marks 317 and 319 along the cross-process direction to form the mark 358 in the row 308 instead of in the row 304A. In the printer 5, the image data for the test pattern 64 include a two-dimensional representation of the test pattern 300, and the controller 50 adjusts the time of operation for the inkjet that prints the mark 358 to place the mark 358 in the row 308 instead of with the mark groups 316, 320, and the other marks in the row 304A.

As described above, each of the rows 304A-304G of the test pattern 300 is formed from a plurality of mark groups that are separated from each other by gaps in each row. Additionally, the test pattern 300 includes groups of marks and corresponding gaps that are offset from each other along the cross-process direction in an arrangement where none of the gaps in any of the rows 304A-304G are aligned with each other in the cross-process direction CP. For example, in FIG. 3 the gap 318 between mark groups 316 and 320 in row 304A is offset from the gap 332 that is formed between mark groups 324 and 328 in row 304B. The groups of marks in the rows 304C-304G are arranged in a similar manner to form gaps in each row that are offset in the cross-process direction from the locations of the gaps in the remaining rows. Since the row 308 includes a series of marks that correspond to the gaps in rows 304A-304G, where no two rows share gaps in the same location, each mark in the row 308 is aligned with the gap formed in only one of the rows 304A-304G.

As described above, the rows 304A-304G include multiple groups of marks that are separated by gaps. The row 308 also includes an arrangement of marks that are formed into groups, including the groups 372 and 376, with a corresponding gap 374 formed between the groups 372 and 376. The marks within the groups 372 and 376 are also separated from each other by a predetermined distance in the cross-process direction, although the separation between adjacent marks in the row 308 is larger than the corresponding separation between marks in the groups of rows 304A-304G. The gap 374 between the mark groups 372 and 376 corresponds to a region between the groups 372 and 376 that does not include a printed mark. However, the printed mark that corresponds to the region 374 is formed in a corresponding location of one of the rows 304A-304G, such as printed mark 378 in row 304B in the illustrative example of FIG. 3. The printed mark 378 is aligned with the gap 374 along the cross-process direction CP. Since the printed mark 378 is in a location of the row 304B that would otherwise be a gap between marks in the group 328. The controller 50 analyzes the row 304B including the mark 378 along with the marks in the groups 324 and 328 to identify the arrangement of mark groups and gaps between mark groups that distinguish the row 304B from the other rows 304A, 304C-304G, and 308 in the test pattern 300. In some embodiments, the test pattern 300 includes a distribution of the printed marks that align with gaps in the row 308 amongst the rows 304A-304G corresponding to different gaps between the groups formed in the row 308.

While FIG. 3 depicts the test pattern 300 with all of the rows 304A-304G and 308 formed on a single region of an image receiving member, in alternative embodiments the printer 5 forms the printed test pattern 300 in a non-contiguous manner with one or more rows distributed over a larger region of the image receiving surface. For example, in one configuration the printer 5 forms a single row of the test pattern 300 in an inter-document zone on the media web 14 between two printed pages. The controller 50 forms different rows of the test pattern 300 in the inter-document zones between different sets of documents during the printing operation. Thus, as described herein, the controller 50 performs image analysis of individual rows in the test pattern 300 since each set of image data from the optical sensor 54 may include only one row or a subset of the rows of the test pattern 300.

Referring again to FIG. 2, the process 200 continues as the optical sensor 54 generates scanned image data of the marks in the test pattern, including the rows of the test pattern that include different mark groups (block 208). As described above, the optical sensor 54 generates a plurality of scanlines of image data in the region of the media web 14 that contains the printed test pattern. Each scanline includes an array of pixels that are arranged in the cross-process direction. The optical sensor 54 generates a series of scanlines that are arranged in the process direction to form a two-dimensional scanned image of the printed test pattern.

Process 200 continues as the controller 50 in the printer 5 identifies the locations of marks in one printed row in a portion of the scanned image data (block 212). In one embodiment the controller 50 identifies successive rows arranged in different portions of the scanned image data along the process direction from the first printed row to the last printed row that pass the optical sensor 54, although in alternative embodiments the controller 50 identifies individual rows in any order. In the test pattern 300, the controller 50 identifies individual rows corresponding to both the rows 304A-304G and the row 308. The controller 50 uses a convolution kernel, template, or other suitable image processing techniques to identify the locations of marks in each row of the test pattern 300.

Using the test pattern 300 as an example, the controller 50 identifies groups of marks in a selected row, such as the row 304A, based on the locations of groups of marks and gaps between the groups of marks. For example, the row 304A includes a plurality of groups of marks including the groups 316, 320, 240, and 384. The row 304B includes another plurality of mark groups such as the groups 324 and 328 that are separated by a gap 332. The row 308 includes mark groups such as groups 372 and 376, with the gap 374 between the groups of marks in the row 308 being aligned in the cross-process direction with another mark 378 that is formed in the test pattern 300. The row 308 includes marks in the groups 372 and 376 that each correspond to a gap in one of the rows 304A-304G. The separation in the cross-process direction between marks in the groups 372 and 376 is greater than the separation between marks in the mark groups of the remaining rows 304A-304G. During the process 200, the controller 50 also identifies the other rows 304A-304G including the printed groups of marks and gaps. The controller 50 identifies the locations of the groups of marks and gaps between groups of marks in each row of the printed test pattern 300 individually.

Process 200 continues as the controller 50 identifies a similarity between the row of printed marks in the scanned image data and the corresponding row in the predetermined test pattern image data (block 216). Under most operating conditions, the optical sensor 54 generates scanned image data of all the printed rows in the test pattern 300 and the controller 50 analyzes the scanned image data in a predetermined order corresponding to the rows in the test pattern image data 64. However, under some operating conditions in the printer 5, the optical sensor 54 may generate scanned image data of the media web 14 that only includes a portion of the rows of the printed test pattern and may miss one or more rows at the beginning or end of the test pattern in the process direction. In prior-art printers, the entire test pattern is unusable if one or more rows are missing from the scanned image data. However, as described below, the controller 50 identifies individual rows with reference to arrangement of individual mark groups and corresponding gaps to enable the printer 5 to use scanned image data of only portions of a test pattern to perform inoperable inkjet and printhead registration processes.

During process 200, the controller 50 compares the portion of the scanned image corresponding to the identified row of marks in the test pattern to a portion of the predetermined image data 64. The controller 50 identifies a level of similarity between the two sets of image data to determine if row of marks in the scanned image data corresponds to the predetermined row in the test pattern image data 64. The scanned image data and the predetermined image data do not have to correspond exactly due to occurrences of inoperable inkjets or small printhead registration errors. Instead, the controller 50 identifies the relative locations of the gaps between mark groups in the test pattern image data and the corresponding locations in the scanned image data.

In one embodiment of the process 200, the locations of the dashes and gaps within a row are determined based on the expected spacing between marks that a set of inkjets in a single printhead form in the printed test pattern. In one embodiment, the controller 50 identifies the locations of individual marks in each printed row of the test pattern using, for example, a curve fitting technique to identify a profile of reflectance values that include a local minimum corresponding to location of reduced reflectance for each printed mark in the image data. Then the controller 50 generates an index of mark positions along the row, where the marks are assigned incrementing integer values (e.g. 0, 1, 2, 3, . . . ) based on the number of marks that are identified in the row from a first end of the row to a second end of the row in the cross-process direction. The index values do not directly correspond to the precise locations of the marks in the row, but instead merely correspond to the relative arrangement of marks that the controller 50 identifies in the scanned image data of the row.

The controller 50 identifies the relative positions of a subset of marks in the first row that inkjets in only a single printhead form in the row based on the identified indices of marks that are found in the row of printed marks. For example, in some embodiments the controller 50 operates a staggered portion of the inkjets in one printhead to form a portion of the marks in each row of the test pattern 300. In one configuration, one printhead operates one inkjet to form one mark in a row, leaves a set of six intermediate inkjets inactive when forming the one row, and operates the seventh inkjet to form another mark in the row. The intermediate inkjets in the one printhead form marks in other rows in the test pattern, and the remaining printheads in the printhead array form the marks in the rows of the test pattern in a similar manner. If an inkjet in the printhead corresponds to a gap in the row, then the controller 50 does not operate the inkjet to form the row but instead operates the inkjet to form a mark in another row, such as the mark 358 in row 308 that corresponds to the gap 318 in row 304A in FIG. 3.

The controller 50 accounts for both expected gaps that are formed between mark groups and gaps that are formed due to inoperable inkjets in one or more of the printheads. For example, in one configuration the controller 50 identifies a series of marks with an expected spacing between marks in the cross-process direction. The controller 50 then identifies successive marks at regular intervals that correspond to marks from a single printhead, such as at an interval of six intermediate marks between successive marks from one printhead. In the test pattern 300, the controller 50 identifies both the gaps that are part of the printed test pattern between mark groups and missing marks that correspond to inoperable inkjets.

During operation, the controller 50 generates an index corresponding to a gap location in the image data to insert a placeholder in the index for the row of the test pattern. The controller 50 generates the index values for both the gaps between mark groups that are expected to be present in the row and for gaps that correspond to inoperable inkjets. The controller 50 identifies index positions of the missing marks (e.g. mark 4, 24 and 28 are missing) and compares the positions of missing marks with the index positions of the inserted gaps (gaps were placed at positions 5, 25 and 29). Each of the expected index locations for a gap corresponds to an index that lies immediately between the highest index of one mark group and the lowest index of an adjacent mark group along the cross-process direction. For example, in FIG. 3 the controller 50 generates the index values for the marks 317 and 319 (e.g. index numbers 14 and 16), with the inserted index value for the gap 318 having index value 15. If all of the inserted gaps are contained with the set of missing marks then the row has been properly identified and aligned.

If there are inserted gaps that are not present in the missing mark set, then the controller 50 repeats the process with a constant value added to all of the missing mark indices. The constant value in the indices effectively inserts one or more missing marks that were present in the predetermined test pattern image data but were not formed in the printed test pattern due to one or more inoperable inkjets. The controller 50 subsequently determines if all of the inserted gap positions align with the new set of missing marks. If the inserted gaps cannot be matched with the detected missing marks by assuming a small number of missing jets at either end, then either the row has been misidentified, or there has been an indexing error during identification of the missing marks. The controller 50 compares the missing mark indices to the inserted gap locations for other rows, to determine if the row has been misidentified and changes the identification of the row if another row matches the locations of gaps between mark groups. If the indices do not correspond to any of the rows in the test pattern 300, then the controller 50 discards the row data and the controller 50 performs the process 200 on another set of scanned image data for a different row.

In another embodiment of the process 200, the controller 50 performs a convolution process to align the test pattern data for the expected row with the scanned image data of the row in the printed test pattern. The controller 50 translates the scanned image data across the image data of the printed test pattern in the cross-process direction to identify a relative location where the convolution function produces a maximum value. The controller 50 then identifies if the gaps between groups of marks in the predetermined test pattern image data are aligned with the gaps in the scanned image data to determine if the two rows have sufficient similarity to be considered a match.

Figure 4A:
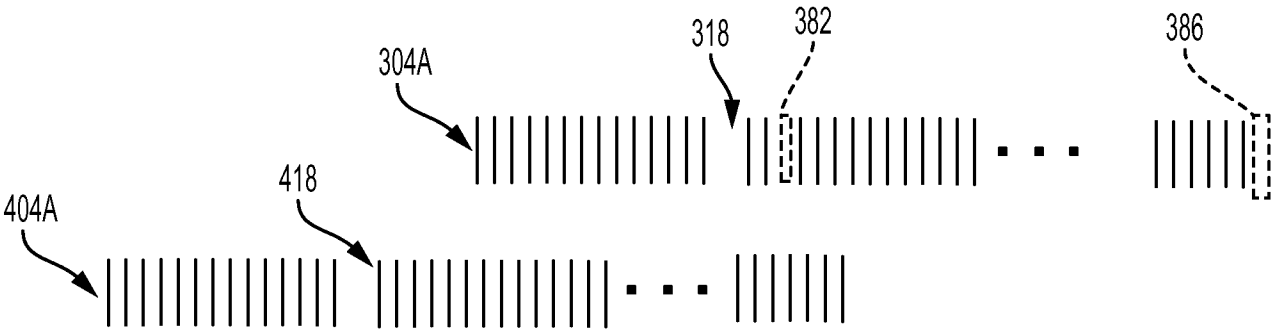
FIG. 4A is a depiction of a first relative position between a predetermined set of image data corresponding to a row of printed marks in a test pattern and a corresponding set of scanned image data of the printed row of marks.
Figure 4B:
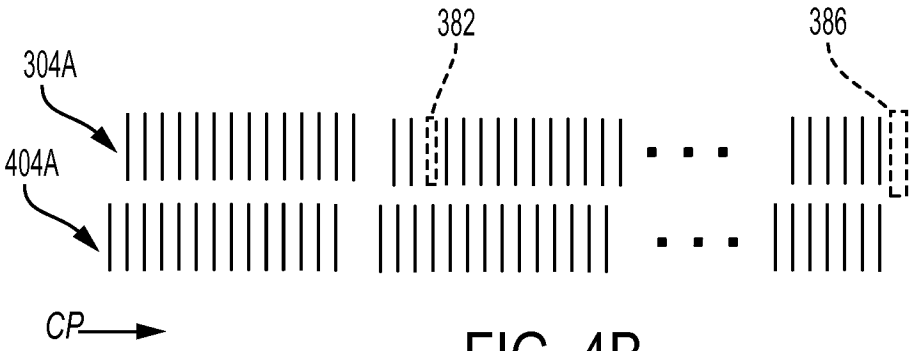
FIG. 4B is a depiction of a second relative position between a predetermined set of image data corresponding to a row of printed marks in a test pattern and a corresponding set of scanned image data of the printed row of marks.
Figure 4C:
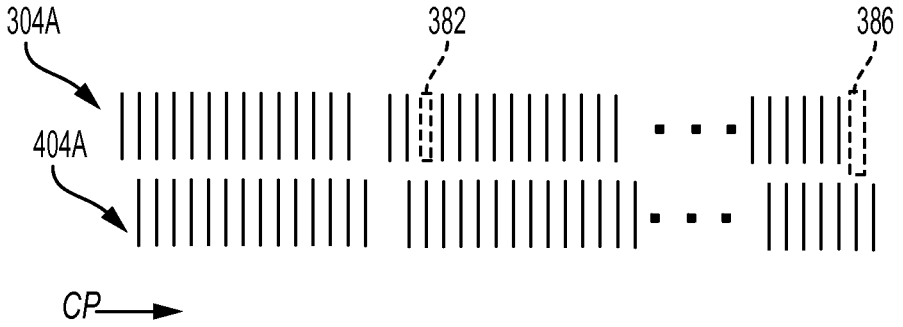
FIG. 4C is a depiction of a third relative position between a predetermined set of image data corresponding to a row of printed marks in a test pattern and a corresponding set of scanned image data of the printed row of marks.
Figure 4D:
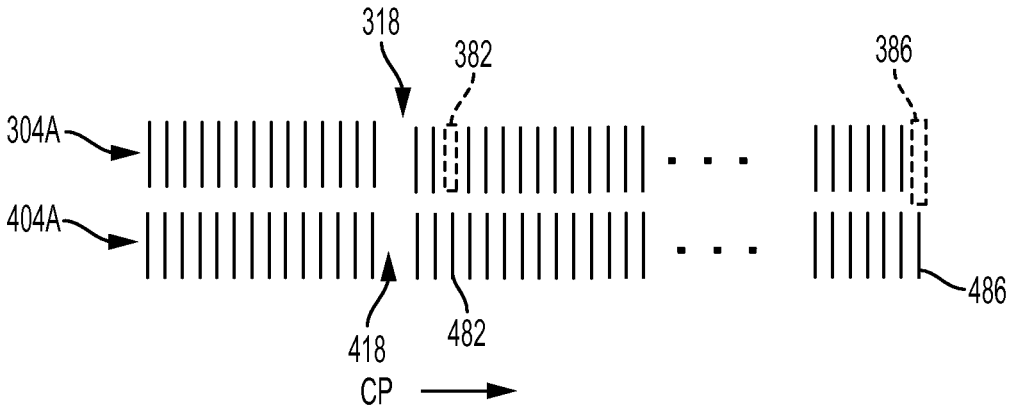
FIG. 4D is a depiction of the predetermined set of image data for the row from FIG. 4A-FIG. 4C in alignment with the set of scanned image data of the printed row of marks from FIG. 4A-FIG. 4C.

FIG. 4A-FIG. 4D are an illustrative depiction of portions of the convolution process. In FIG. 4A, the controller 50 begins translation of the predetermined image data 404A that correspond to row 304A across the scanned image data in the cross-process direction CP. The predetermined image data 404 includes a gap 418 that corresponds to the gap 318 between mark groups in the scanned image data of the row 304A. As depicted in FIG. 4B and FIG. 4C, the controller 50 continues translation of the predetermined image data row 404A across the scanned image data row 304A including a locations with a misalignment corresponding to one mark to the left (FIG. 4B) and one mark to the right (FIG. 4C) along the cross-process direction. FIG. 4D depicts the relative location in the convolution in which the controller 50 generates a maximum convolution value corresponding to the greatest similarity between the positions of marks in both rows 304A and 404A. The controller 50 can align the test pattern and scanned image data without a precise match between every mark in the two rows. Instead, the controller 50 identifies the maximum convolution data even in the presence of some missing marks such as the missing mark 386 that does not match the corresponding mark 486 in the predetermined test pattern.

After the alignment process, the controller 50 identifies if the gaps between mark groups in the predetermined image data correspond to the cross-process direction locations of gaps between mark groups in the scanned image data. If the gaps are aligned in the cross-process direction between both sets of image data, then the controller 50 identifies that the row of scanned image data corresponds to the same row in the predetermined scanned image data 64 (block 220). In a practical embodiment, each row of marks contains multiple gaps between a series of mark groups, and a single row may include a large number (e.g. dozens or hundreds) of gaps. The controller 50 optionally identifies if the gaps between the two rows are in alignment using a predetermined threshold, such as 90% alignment between gaps, to account for noise and other image artifacts that may affect a small number of gaps in the scanned image data. If, however, the gaps between the scanned image data and the predetermined test pattern data do not align with each other (block 220), then the controller 50 selects another row from the predetermined test pattern data 64. The controller 50 continues the comparison process of blocks 216 and 220 until the controller identifies the row of the scanned image data with a corresponding row in the predetermined test pattern image data.

Process 200 continues as the printer 5 identifies inoperable inkjets in the plurality of inkjets that form the identified row in the test pattern using the scanned image data and the predetermined test pattern image data corresponding to the row (block 224). As described above, the controller 50 performs a convolution process to align the scanned image data of the printed test pattern with the predetermined image data that the printer 5 uses to form the row in the printed test pattern. If all of the inkjets that form the row are operational, then each mark in the predetermined test pattern data corresponds to a location of a printed mark in the scanned image data of the printed test pattern. However, in some instances one or more inoperable inkjets fail to emit ink drops to form a mark or form the mark in an incorrect location.

During process 200, the controller 50 identifies inoperable inkjets that are located at both ends of the row of printed marks in the cross-process direction and within the row with reference to the identification that one mark in the predetermined image data is not present in a corresponding location of the aligned scanned image data from the printed test pattern. For example, in FIG. 3 the plurality of inkjets that form the row 304A include a first inoperable inkjet that fails to print a mark in the location 382 within a mark group and another inoperable inkjet that fails to print a mark in the location 386 at one end of the row 304A along the cross-process direction CP. The controller 50 identifies the inoperable inkjets based on the positions of marks in the predetermined test pattern image data that do not align with any marks in the scanned image data of the printed test pattern. For example, in FIG. 4D the gaps 382 and 386 in the row 304A correspond to inoperable inkjets. The controller 50 identifies the inoperable inkjets based on the locations of marks 482 and 486, respectively, in the aligned image data row 404A. The controller 50 identifies inoperable inkjets at either a first end or second end of the row of printed marks in the cross-process direction based on the location of the missing mark in the predetermined image data after the two rows are aligned in the cross-process direction.

In the process 200, the arrangement of marks into mark groups with gaps between mark groups enables the controller 50 to identify the correct locations of inoperable inkjets that are located at a first or second end of the row in the cross-process direction. Prior art inoperable inkjet detection systems can identify that one or more inkjets at one end of a row are inoperable. However, the prior art inoperable inkjet detection techniques often inaccurately identify the end of the row that actually corresponds to the inoperable inkjets, such as mistakenly identifying an inoperable inkjet at the left end of the row instead of the right end.

During process 200, the controller 50 aligns the predetermined test pattern image data in the row 404 with the scanned image data of the row 304A based on the arrangement of mark groups and gaps between mark groups to enable the controller 50 to identify the correct inoperable inkjet for the missing mark 386 on the right end of the row 304A. Because the controller 50 operates a predetermined set of inkjets to form each mark in the row based on the predetermined test pattern image data, the controller 50 correctly identifies the inoperable inkjet corresponding to the mark that is present in the predetermined image data but is missing from the scanned image data. The controller 50 aligns the two rows 304A and 404 to avoid an incorrect identification of another inkjet located at the left end of the row 304A as being the inoperable inkjet. The aligned image data also enables the controller 50 to identify the correct inoperable inkjet if an inkjet at either a first end or a second end of a mark group is inoperable. The same image analysis process also enables the controller 50 to identify inoperable inkjets that are within a group of marks, such as the inoperable inkjet that corresponds to the missing mark 382 within the mark group 340.

Process 200 continues with the processing of blocks 202-224 described above for any additional rows of printed marks in the image data (block 228). After processing all rows of printed marks that are present in the scanned image data, the printer 5 continues operation with optional inoperable inkjet remediation and printhead registration processes (block 232). Inoperable inkjet remediation operations include printhead purging and cleaning processes to return inoperable inkjets to operation or inoperable inkjet compensation operations to reduce the effects of inoperable inkjets on the image quality of printed images. The controller 50 optionally identifies a location of one or more printheads that form the marks in each row with reference to the center position of all the marks in the row from the inkjets in each printhead. Additionally, in some embodiments, each printhead forms marks in multiple rows of the test pattern and the controller 50 identifies the printhead location in the cross-process direction based on an average of the locations of marks from all rows in the test pattern. During a printhead registration process, the controller 50 operates one or more electromechanical actuators to correct any registration errors that occur when the controller 50 identifies that one or more printheads are not aligned in proper cross-process direction locations with each other.

During operation, the printer 5 performs the process 200 for the row of marks 308 in the printed test pattern 300 in the same manner as for the rows 304A-304G using the predetermined test pattern image data 64 for the row 308 to identify the arrangement of marks in the row 308. As described above, the row 308 also includes a plurality of mark groups that are formed on the image receiving surface. The cross-process direction spacing between marks and mark groups in the row 308 is greater than in the remaining rows 304A-304G because the row 308 includes marks formed by inkjets that occupy the gaps between mark groups in the remaining rows 304A-304G. Even though the row 308 includes a different arrangement of mark groups than the other rows, the gaps between mark groups in the row 308, such as the gap 374 in FIG. 3, occupy different locations in the cross-process direction from each of the other rows 304A-304G. The controller 50 identifies the row 308 and performs the inoperable inkjet detection and printhead registration processes in the same manner as for the rows 304A-304G.

It will be appreciated that variants of the above-disclosed and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the following claims.

What is claimed:

1. A method of test pattern analysis in a printer comprising:

operating with a controller a first plurality of inkjets to form a first row of printed marks arranged in a cross-process direction on an image receiving surface with reference to predetermined image data that include the first row of marks and a second row of marks, the first row of marks including a first plurality of marks and a second plurality of marks, the first plurality of marks being separated from the second plurality of marks by a first gap in the predetermined image data in a first location in the cross-process direction, the first location being different than a second location in the cross-process direction of a second gap formed between a third plurality of marks and a fourth plurality of marks in the second row in the predetermined image data;

operating with the controller a second plurality of inkjets to form the second row of printed marks arranged in the cross-process direction on the image receiving surface with reference to the predetermined image data of the second row of marks, the second row of printed marks being offset from the first row of printed marks in a process direction;

operating with the controller a third plurality of inkjets with reference to a third row of marks in the predetermined image data to form a first printed mark and a second printed mark in a third row of printed marks on the image receiving surface, the first printed mark in the third row of printed marks being located between the first plurality of printed marks and the second plurality of printed marks in the cross-process direction, the second printed mark in the third row of printed marks being located between the third plurality of printed marks and the fourth plurality of printed marks in the cross-process direction, and the third row of printed marks being offset from the first row of printed marks and the second row of printed marks in the process direction;

generating with an optical sensor scanned image data of the first row, the second row, and the third row of printed marks; and identifying with the controller the first row of printed marks in the scanned image data with reference to a location of the first plurality of printed marks, a location of the second plurality of printed marks, and a location of the first gap on the image receiving surface between the first plurality of marks and the second plurality of marks in the first row of marks in the cross-process direction.

2. The method of claim 1 further comprising:

identifying with the controller the second row of printed marks in the scanned image data with reference to a location of the third plurality of printed marks, a location of the fourth plurality of printed marks, and a location of the second gap on the image receiving surface between the third plurality of marks and the fourth plurality of marks in the second row of marks in the cross-process direction.

3. The method of claim 1, the identification of the first row of printed marks further comprising:

aligning with the controller a portion of the predetermined image data including the first row with the scanned image data corresponding to the first row of printed marks at a location in the cross-process direction corresponding to a maximum value of a convolution of the portion of the predetermined image data with the scanned image data;

identifying with the controller an inoperable inkjet in the first plurality of inkjets located at the first end of the first row of printed marks in the cross-process direction in response to a location of a mark in the first portion of the predetermined image data located at the first end of the first row not being aligned with any mark in the scanned image data; and identifying with the controller another inoperable inkjet in the first plurality of inkjets located at the second end of the first row of printed marks in the cross-process direction in response to a location of a mark in the first portion of the predetermined image data located at the second end of the first row not being aligned with any mark in the scanned image data.

4. The method of claim 1 further comprising:

aligning with the controller a first portion of the predetermined image data including the first row with the scanned image data corresponding to the first row of printed marks at a location in the cross-process direction corresponding to a maximum value of a convolution of the first predetermined image data with the scanned image data; and identifying with the controller a location of a printhead including at least a portion of the plurality of inkjets that form the first plurality of printed marks in the first row of printed marks with reference to a location of the aligned first portion of the predetermined image data in the cross-process direction.

5. The method of claim 1, the identification of the first row further comprising:

generating with the controller an index for each mark in the first plurality of printed marks and the second plurality of printed marks in the first row with reference to the scanned image data;

generating with the controller another index for the first gap on the image receiving surface with reference to the scanned image data; and identifying with the controller the first row of printed marks in response to the index for the first gap on the image receiving surface being between an index of one printed mark in the first plurality of printed marks having a highest index value for the first plurality of printed marks and another printed mark in the second plurality of printed marks having a lowest index value for the second plurality of printed marks.

6. An inkjet printer comprising:

a first plurality of inkjets configured to eject ink drops onto an image receiving surface as the image receiving surface moves in a process direction;

a second plurality of inkjets configured to eject ink drops onto the image receiving surface as the image receiving moves in the process direction;

a third plurality of inkjets configured to eject ink drops onto the image receiving surface as the image receiving moves in the process direction;

an optical sensor configured to generate image data of the image receiving surface;

a memory configured to store predetermined image data that include a first row of marks and a second row of marks, the first row of marks including a first plurality of marks and a second plurality of marks, the first plurality of marks being separated from the second plurality of marks by a first gap in the predetermined image data in a first location in the cross-process direction, the first location being different than a second location in the cross-process direction of a second gap formed between a third plurality of marks and a fourth plurality of marks in the second row of marks in the predetermined image data; and a controller operatively connected to the first plurality of inkjets, the second plurality of inkjets, the third plurality of inkjets, the optical sensor, and the memory the controller being configured to:

operate the first plurality of inkjets to form a first row of printed marks arranged in a cross-process direction on the image receiving surface with reference to the predetermined image data for the first row of marks;

operate the second plurality of inkjets to form a second row of printed marks arranged in the cross-process direction on the image receiving surface with reference to the predetermined image data of the second row of marks, the second row of printed marks being offset from the first row of printed marks in a process direction;

operate the third plurality of inkjets with reference to a third row of marks in the predetermined image data to form a first printed mark and a second printed mark in a third row of printed marks on the image receiving surface, the first printed mark in the third row of printed marks being located between the first plurality of printed marks and the second plurality of printed marks in the cross-process direction, the second printed mark in the third row of printed marks being located between the third plurality of printed marks and the fourth plurality of printed marks in the cross-process direction, and the third row of printed marks being offset from the first row of printed marks and the second row of printed marks in the process direction;

generate with the optical sensor scanned image data of the first row, the second row, and the third row of printed marks; and identify the first row of printed marks in the scanned image data with reference to a location of the first plurality of printed marks, a location of the second plurality of printed marks, and a location of the first gap on the image receiving surface between the first plurality of printed marks and the second plurality of printed marks in the first row of printed marks in the cross-process direction.

7. The printer of claim 6, the controller being further configured to:

identify the second row of printed marks in the scanned image data with reference to a location of the third plurality of printed marks, a location of the fourth plurality of printed marks, and a location of the second gap on the image receiving surface between the third plurality of printed marks and the fourth plurality of printed marks in the second row of printed marks in the cross-process direction.

8. The printer of claim 6, the controller being further configured to:

align a portion of the predetermined image data including the first row with the scanned image data corresponding to the first row of printed marks at a location in the cross-process direction corresponding to a maximum value of a convolution of the portion of the predetermined image data with the scanned image data;

identify an inoperable inkjet in the first plurality of inkjets located at the first end of the first row of printed marks in the cross-process direction in response to a location of a mark in the first portion of the predetermined image data located at the first end of the first row not being aligned with any mark in the scanned image data; and identify another inoperable inkjet in the first plurality of inkjets located at the second end of the first row of printed marks in the cross-process direction in response to a location of a mark in the first portion of the predetermined image data located at the second end of the first row not being aligned with any mark in the scanned image data.

9. The printer of claim 6, the controller being further configured to:

align a first portion of the predetermined image data including the first row with the scanned image data corresponding to the first row of printed marks at a location in the cross-process direction corresponding to a maximum value of a convolution of the first predetermined image data with the scanned image data; and identify a location of a printhead including at least a portion of the plurality of inkjets that form the first plurality of printed marks in the first row of printed marks with reference to a location of the aligned first portion of the predetermined image data in the cross-process direction.

10. The printer of claim 6, the controller being further configured to:

generate an index for each mark in the first plurality of printed marks and the second plurality of printed marks in the first row with reference to the scanned image data;

generate another index for the first gap on the image receiving surface with reference to the scanned image data; and identify the first row of printed marks in response to the index for the first gap on the image receiving surface being between an index of one printed mark in the first plurality of printed marks having a highest index value for the first plurality of printed marks and another printed mark in the second plurality of printed marks having a lowest index value for the second plurality of printed marks.

* * * * *